United States Patent [19]

Sugiyama et al.

[11] Patent Number: 4,979,589

[45] Date of Patent: Dec. 25, 1990

[54] WORK APPARATUS FOR A WORK ON A WALL SURFACE

[75] Inventors: Yutaka Sugiyama; Shizuka Kuryu, both of Tokyo, Japan

[73] Assignee: Nihon Biso Kabushiki Kaisha, Tokyo, Japan

[21] Appl. No.: 380,819

[22] Filed: Jul. 17, 1989

[30] Foreign Application Priority Data

Jul. 19, 1988 [JP] Japan ..... 63-179457

[51] Int. Cl.[5] ..... E04G 21/24; E04G 3/00

[52] U.S. Cl. ..... 182/38; 182/138

[58] Field of Search ..... 182/38, 37, 36, 129, 182/142, 138

[56] References Cited

U.S. PATENT DOCUMENTS

| | | | |
|---|---|---|---|
| 654,780 | 7/1900 | Burchill | 182/38 X |
| 2,645,531 | 7/1953 | Rector | 182/38 X |
| 4,129,197 | 12/1978 | Preston | 182/138 X |
| 4,378,860 | 4/1983 | Newberry | 182/38 |
| 4,738,335 | 4/1988 | Ishii | 182/138 X |
| 4,811,819 | 3/1989 | Sugiyama | 182/138 X |

*Primary Examiner*—Karen J. Chotkowski

*Attorney, Agent, or Firm*—Hedman, Gibson, Costigan & Hoare

[57] ABSTRACT

A work apparatus for a work on a wall surface of a structure, e.g., a building, comprises rail supports secured fixedly to an upper end portion of a structure, upper provisional horizontal rails supported provisionally on these rail supports, lower provisional horizontal rails mounted provisionally on a lower portion of a wall surface of the structure in parallel with the upper provisional horizontal rails, upper horizontally running trolleys mounted slidably on the upper provisional horizontal rails and connected to one another, a working platform, e.g., a moving scaffold, hung from the upper horizontally running trolleys in a manner to be movable in the vertical direction, a hanging frame hung from the upper horizontally running trolleys, a protecting material such as a protecting net hung from the hanging frame in a manner to enclose the working platform, a protecting material platform connected to the lower end of the protecting material, and lower horizontally running trolleys secured to the protecting material platform and mounted slidably on the lower provisional horizontal rails. In this work apparatus, a portion of the structure covered by a protecting net is minimized so that a work at an elevated location can be done by covering only a minimal portion necessary for the work.

4 Claims, 7 Drawing Sheets

1
2
12
12a
12b
12c
12d
12e
12f
13
13a
13b
13c
13d
13e
14
14a
14b
15

WORK APPARATUS FOR A WORK ON A WALL SURFACE

BACKGROUND OF THE INVENTION

This invention relates to a work apparatus for a work on a wall surface of a structure and, more particularly, to a work apparatus capable of minimizing a portion of the structure covered by a protecting net so that a work at an elevated location can be done by covering only a portion of the structure on which the work is carried out by a working platform of a moving scaffold or the like appratus which can move vertically and horizontally along the outer wall surface of the structure.

For performing works at elevated locations such as construction and repair of a wall surface of buildings, ships, power stations, tanks, chimneys and bridges safely and efficiently, work apparati for elevated places such as moving scaffolds and unmanned machines are often used instead of conventional provisional scaffolds.

When a moving scaffold which is one of such work apparati used at elevated locations is applied to a building, for example, the moving scaffold is hung from a pair of mounting frames secured to a parapet on the roof of the building by means of wires and is moved vertically by means of winders mounted on the moving scaffold.

In such moving scaffold, work in the vertical direction can be peformed efficiently but work performed on a wall portion outside of the width of the moving scaffold can only be performed within the reach of a workman's hand. It is therefore necessary to shift the position of the moving scaffold horizontally along the wall surface by dismounting the mounting frames from one place and mounting them on another place in the parapet on the roof. As the area of work in the horizontal direction increases, the number of such remounting of the moving scaffold increases with a resulting decrease in the work efficiency.

For obviating such remounting of the moving scaffold, there has been proposed an apparatus in which a running rail is permanently provided on a roof of a building for trolleys to run along the running rail and a moving scaffold is hung from these trolleys by means of wires. There has also been proposed an appratus, as in Japanese Laid Open Patent Publication No. 61-185848, in which a horizontal rail is provisionally mounted on the roof of a building through mounting frames and a moving scaffold is hung from trolleys slidably mounted on the horizontal rail. Work efficiently can be increased by using a work apparatus such as a moving scaffold which can move not only vertically but also horizontally as described above.

In performing such work on a wall surface at an elevated location, a protecting net is normally provided over all of the wall surface on which the work is to be performed.

Since the entire wall surface of the structure is covered by the protecting net regardless of the position of the moving scaffold, considerable time is required for mounting and dismounting the protective net. Besides, a great deal of material is required for providing the protective net over the entire wall surface. Furthermore, safety measures must be taken for ensuring safety in hanging a heavy material for providing the protective net which results in further increase in the cost.

Moreover, in a structure such as a building which is being used, it is a problem that even a portion of a building which is irrelevant to the work is covered until the work is finished.

The same problems arise in work apparati used for work at elevated locations other than moving scaffolds.

It is, therefore, an object of the invention to provide a work apparatus for a work on a wall surface of a structure capable of moving vertically and horizontally and capable of performing a work while covering only a portion of the wall surface which is necessary for the work with a protecting net.

SUMMARY OF THE INVENTION

The work apparatus achieving this object is characterized in that it comprises rail supports secured fixedly to an upper end portion of a structure and having their foremost end portion projecting out of the structure, upper provisional horizontal rails supported provisionally on these rail supports, lower provisional horizontal rails mounted provisionally on a lower portion of a wall surface of the structure in parallel with the upper provisional horizontal rails, upper horizontally running trolleys mounted slidably on the upper provisional horizontal rails and connected to one another, a working platform hung from the upper horizontally running trolleys in a manner to be movable in the vertical direction, a hanging frame hung from the upper horizontally running trolleys, a protecting material hung from the hanging frame in a manner to enclose the working platform, a protecting material platform connected to the lower end of the protecting material, and lower horizontally running trolleys secured to the protecting material platform and mounted slidably on the lower provisional horizontal rails.

According to the invention, the rail supports are secured to the parapet or the like provided on the upper end portion of the structure and the upper provisional horizontal rail is mounted on the rail supports and further the lower provisional horizontal rail is mounted on the lower portion of the wall surface to be worked on. The working platform and the hanging frame for hanging the protective material are hung from the upper horizontally running trolleys. The protecting material platform is connected to the lower edge of the protecting material and this protecting material platform can be moved along the lower horizontal rail through the lower horizontally running trolleys without substantially forming a gap between the platform and the wall surface. The protecting material and the protecting material platform can be moved with the working platform which is moved vertically and horizontally with progress of the work whereby an area on the wall surface in which work is currently performed only is covered with the protecting material.

The amount of the protective material and other materials has only to be one corresponding to the width of the moving scaffold so that the protective material can be mounted and dismounted at a reduced cost and within a shortened period of time.

Moreover, the influence on the structure which is being used can be held at the minimum.

In one aspect of the invention, the protecting material hung from the hanging frame covers only a portion of the wall surface below the middle portion of the working platform and this protective material is moved vertically in accordance with the vertical movement of the working platform. By this arrangement, the portion covered by the protecting material can further be reduced in area whereby the weight of the protective material hung is decreased and reliability of the apparatus can be improved.

BRIEF DESCRIPTION OF THE DRAWINGS

In the accompanying drawings,

FIGS. 1 to 8 illustrate an embodiment in which the invention has been applied to a moving scaffold used for a work at an elevated location on a wall surface in which, FIG. 1 is a front view of the apparatus;

FIG. 5 is a plan view of a provisional horizontal rail;

FIG. 6 is a sectional view of a horizontally running trolley;

FIG. 7 is a front view of the entire apparatus; and

FIG. 8 is a view for schematically illustrating the area of work; and

FIGS. 9 to 11 illustrate another embodiment of the invention in which

FIG. 9 is a front view of the apparatus;

FIG. 10 is a side view thereof; and

FIG. 11 is a view for schematically illustrating the area of work.

DESCRIPTION OF PREFERRED EMBODIMENTS

Figure 2A:
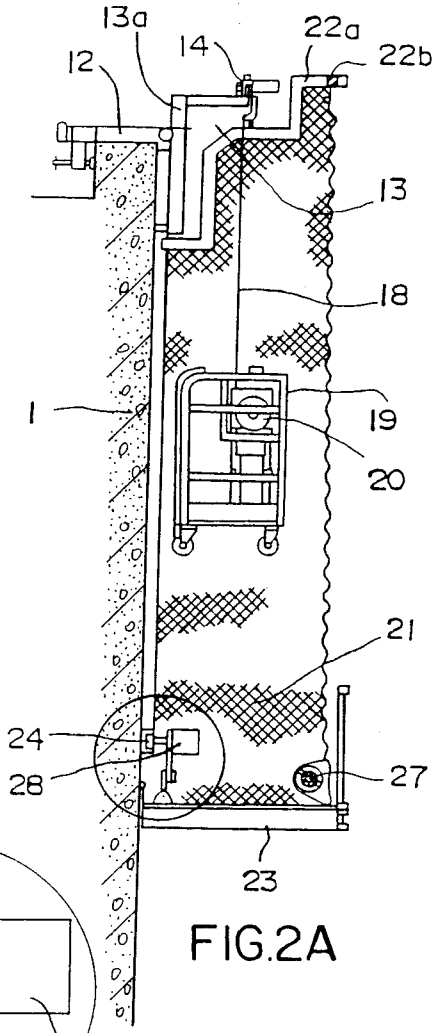
FIG. 2A is a side view thereof.
Figure 2B:
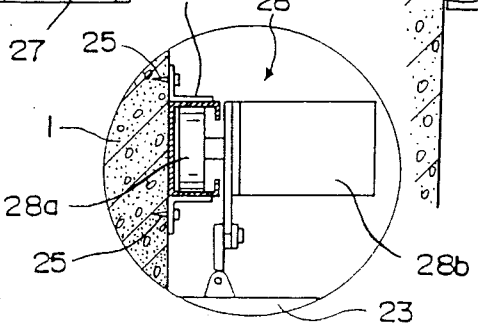
FIG. 2B in an enlarged view of the horizontally running-trolley shown in FIG. 2A.
Figure 1:
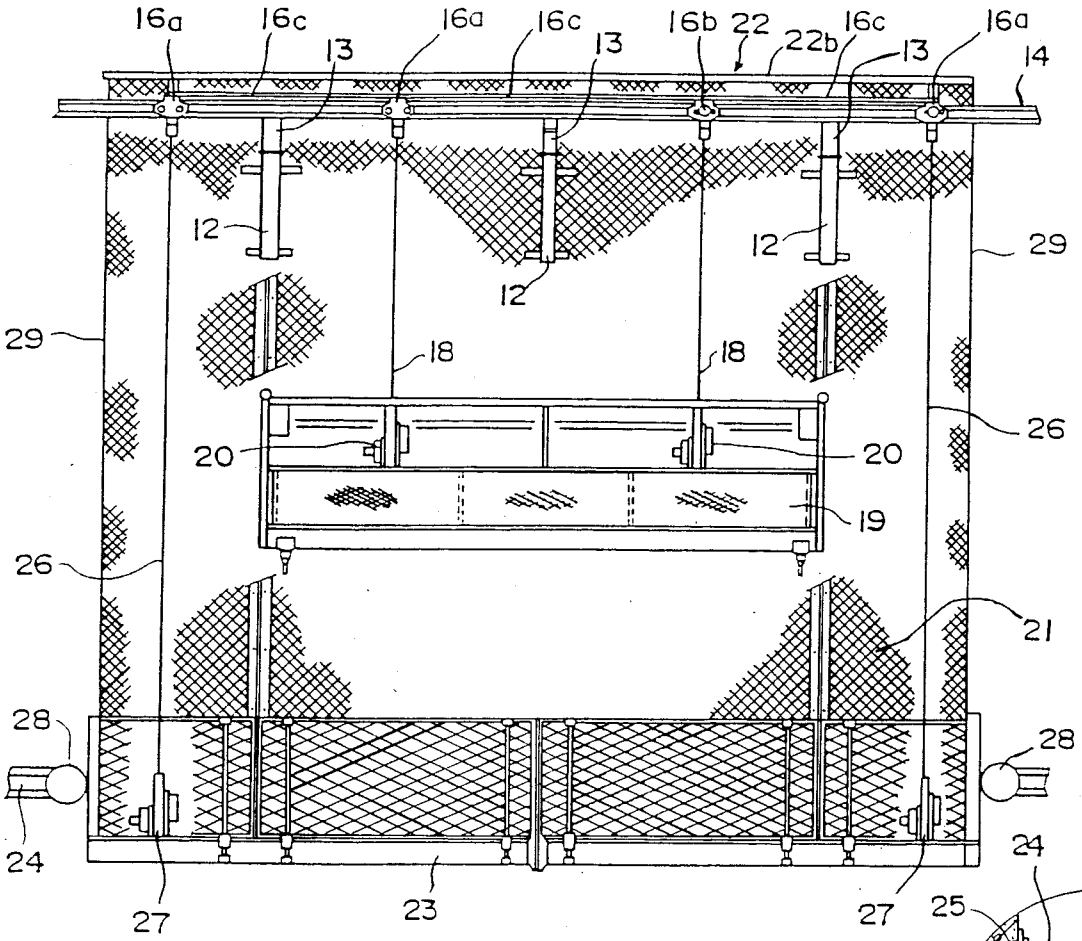
Figures 3A, 3B, 4A, 4B, 4C:
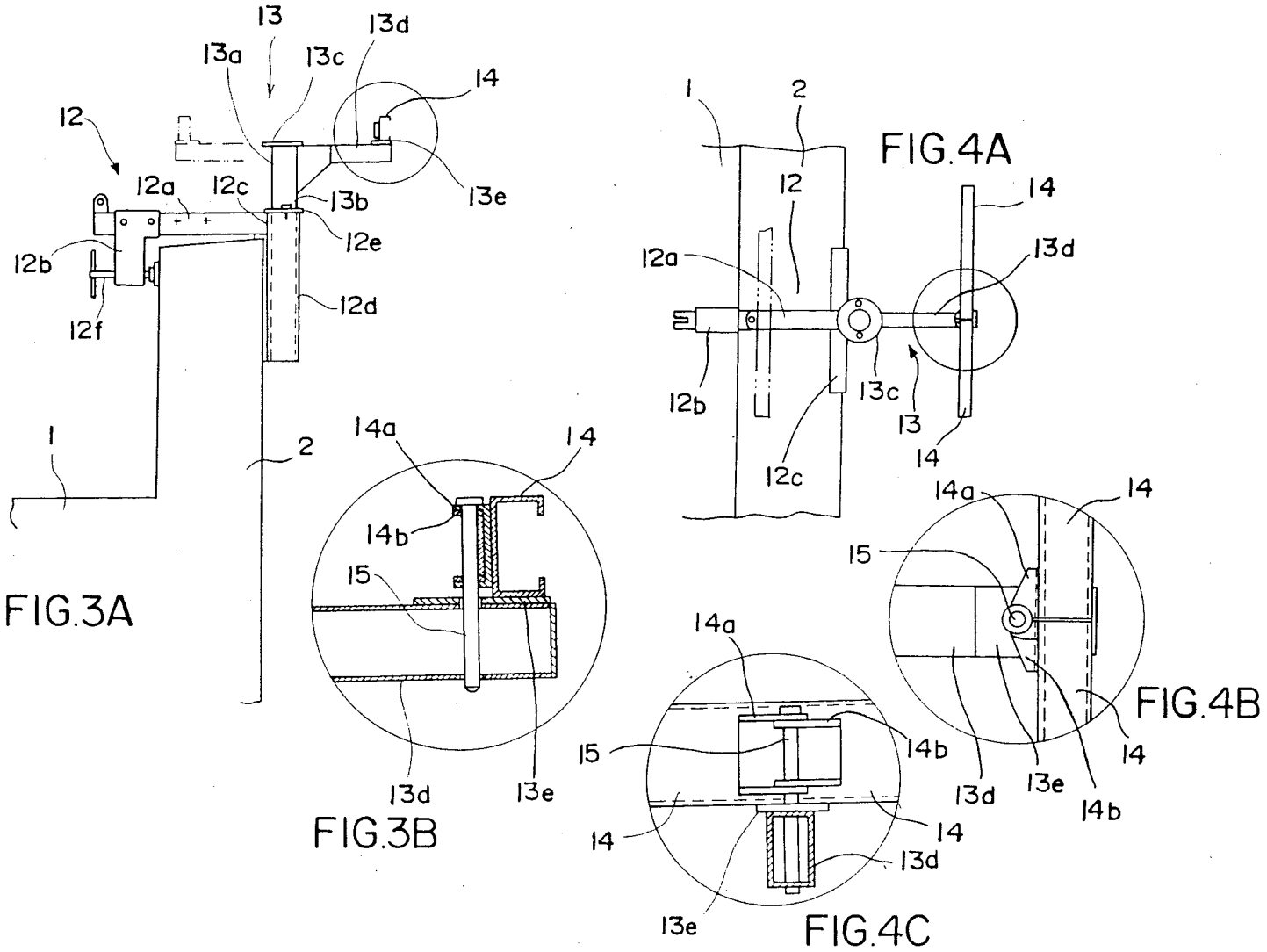
FIG. 3A is a side view of a provisional horizontal device.
FIG. 3B is an enlarged view of the rails shown in FIG. 3A
FIG. 4A is a plan view of the provisional horizontal device.
FIG. 4B is an enlarged plan view of the bracket and connecting pin shown in FIG. 4A.
FIG. 4C is an enlarged side view of the bracket and the connecting pin shown in FIG. 4B.

FIG. 1 is a front view of an embodiment of the invention applied to a moving scaffold used for a work performed at an elevated location and FIGS. 2A and 2B are side views thereof.

In a work apparatus 10 for a work on a wall surface of a structure, a moving scaffold which can be moved vertically is adapted to be moved horizontally by means of a provisional horizontal device and, further, a protecting net having a width larger than the width of the moving scaffold can be moved horizontally with the moving scaffold in a state in which the protecting net covers the entire range of vertical movement of the moving scaffold.

A provisional horizontal device 11 comprises, as shown in FIGS. 3A, 3B and 4A–4C, supports frames 12 on which rail supports 13 to be described later are fixedly mounted. These support frames 12 are secured to a parapet 2 formed at the upper end of a roof of a building 1.

Each of these support frames 12 comprises a horizontal support bar 12*a* and a vertical arm 12*b* fitted slidably on this support bar 12*a*. The position of the arm 12*b* is determined suitably in accordance with the thickness of the parapet 2 by selecting position of bolts which are inserted in holes of the support bar 12*a*. To the foremost end portion of the support bar 12*a* are welded an L-shaped plate 12*c* which is disposed horizontally and fitted on the corner position of the parapet 2 and a vertically disposed cylindrical support portion 12*d* which opposes the arm 12*b*. A flange 12*e* is secured to the upper end of the cylindrical support portion 12*d*. A screw jack 12*f* is provided in the arm 12*b* for fixing the support frame 12 to the parapet 2 by clamping the parapet 2 between the arm 12*b* and the cylindrical support portion 12*d*.

To each of the support frame 12 is mounted the rail support 13 rotatably and fixably. The rail support 13 comprises a post 13*a* which is fitted in the cylindrical support portion 12*d* in such a manner that it is rotatable about a vertical axis. A flange 13*b* is secured at the middle portion of the post 13*a* in a manner to abut against the flange 12*e* at the upper end of the cylindrical support portion 12*d*. A flange 13*c* is also secured at the upper end of the post 13*a* so that this post 13*a* can be utilized also for supporting a part of an auxiliary device for performing a work on a wall surface by the moving scaffold, e.g., a swivel arm of a hoist.

To the upper end portion of the post 13*a* is welded a root portion of a horizontally projecting arm 13*d*. To the upper surface of the foremost end portion of the horizontal arm 13*d* is secured a reinforcing plate 13*e* and upper provisional horizontal rails 14 are placed on the reinforcing plate 13*e*. Openings for securing the upper provisional horizontal rails 14 are formed in the horizontal arm 13*d* and the reinforcing plate 13*e* and the upper provisional horizontal rails 14 are rotatably mounted on the horizontal arm 13*d* by means of a connecting pin 15 which is inserted in these openings.

A connecting portion of adjacent rails 14 is placed on the reinforcing plate 13*e* and supported thereon.

The upper provisional horizontal rails 14 are of a squarish C-shaped cross section and is made of a channel steel having a lip portion. At the back of one end portion of the rail 14 is welded a bracket 14*a* having a relatively large vertical opening and at the back of the other end portion of the rail 14 is welded a bracket 14*b* which can engage in the bracket 14*a*. Two adjacent rails 14 are rotatably mounted on the rail support 13 by means of the connecting pin 15 inserted in the brackets 14*a* and 14*b* in a state where the adjacent end surfaces of the rails 14 are in abutting engagement with each other in the central portion of the horizontal arm 13*d*.

Accordingly, when the upper provisional horizontal rails 14 are displaced toward or away from the building 1 by rotating the post 13*a* of the rail support 13 fitted in the cylindrical support portion 12*d* of the support frame 12, the rails 14 can be displaced while the state of the adjacent end surfaces of the rails 14 in abutting engagement is maintained and the rails 14 slide over the reinforcing plate 13*e* of the rail support 13.

Figure 5:
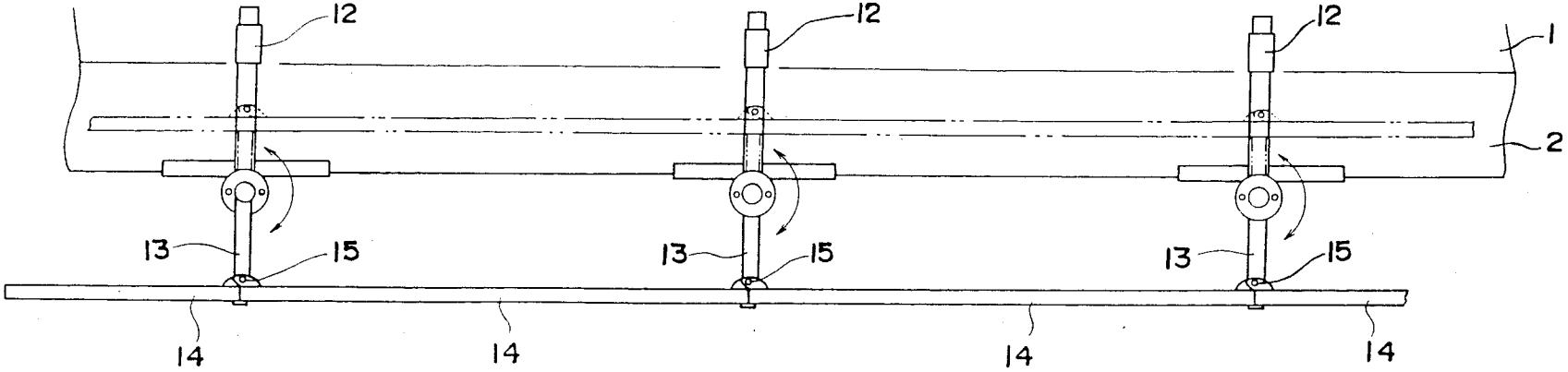

Thus, as shown in FIG. 5, the upper provisional horizontal rails 14 are supported in the connected state by the rail supports 13 which are supported by the support frames 12 secured to the parapet 2 of the building 1 at a predetermined interval in correspondence to the length of each rail 14 and the rails 14 are provided in this manner in a necessary work range of the moving scaffold.

In connecting the adjacent rails 14, the rail supports 13 are rotated so that the horizontal arms 13*d* are located inside the outer edge of the parapet 2 as shown by chain and dot lines in FIG. 5 and the operator can achieve the connection of the rails 14 safely.

Figure 6:
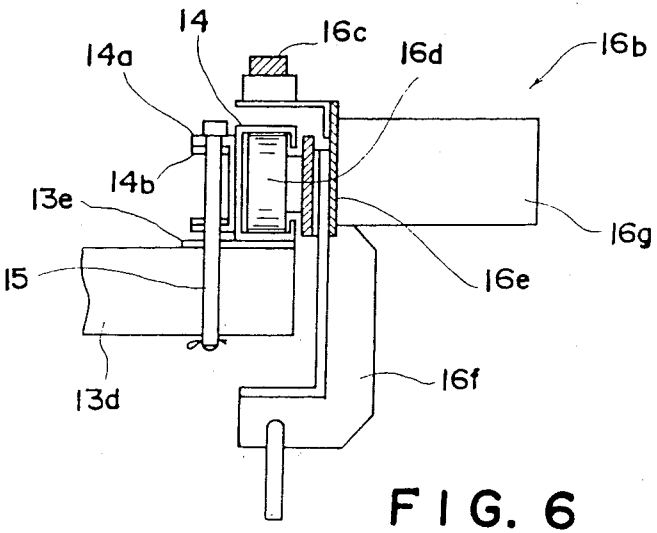
Figure 7:
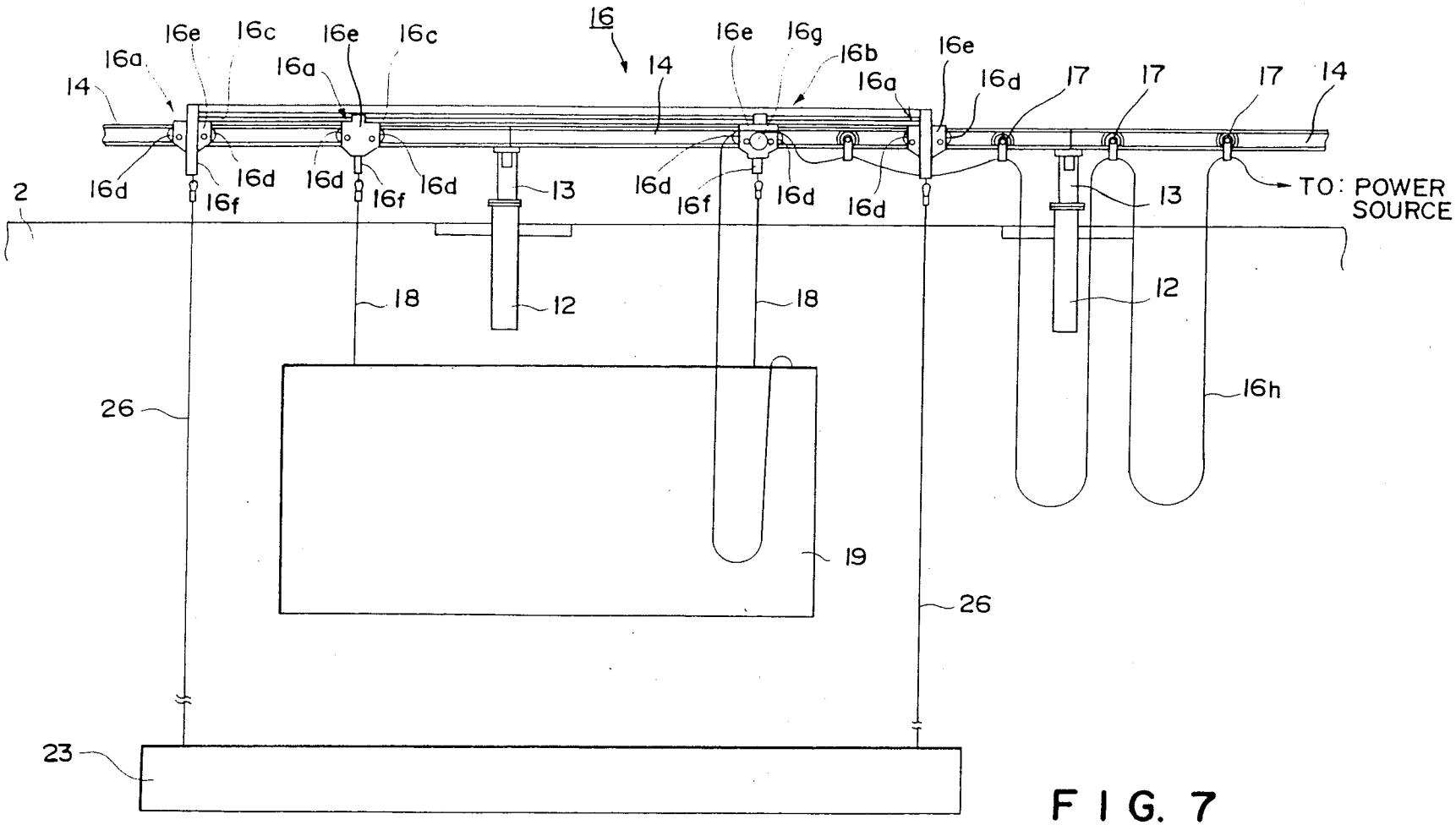

Upper horizontally running trolleys 16 running along the upper provisional horizontal rails 14 consist, as shown in FIGS. 6 and 7, of four trolleys, namely three driven trolleys 16*a* and a single drive trolley 16*b*. These four trolleys 16 are connected to one another by a connecting rod 16c so that the four trolleys 16 run integrally and synchronously along the rails 14.

Each of the driven trolleys 16a and the drive trolley 16b includes a couple of rollers 16d mounted in a frame 16e. These trolleys 16 each have a hook 16f secured to the frame 16e. The moving scaffold is hung from the hooks 16f of the inside driven trolley 16a and the drive trolley 16b whereas a protecting net is hung from the two outside driven trolleys 16a.

To one of the rollers 16d of the drive trolley 16b is connected to a motor 16g through a reduction gear (not shown) and this roller 16d is driven by the motor 16g. A electric power cable 16h is suspended by roller hangers 17 which are provided to run along the upper provisional horizontal rails 14. The electric power cable 16h is slackened sufficiently so as to cope with running of the trolleys 16.

Wires 18 for suspending a moving scaffold 19 are tied to the hooks 16f of the inside driven trolley 16a and the drive trolley 16b. By operating winders 20 (see FIGS. 1, 2A and 2B, the moving scaffold 19 is moved in the vertical direction.

Thus, the moving scaffold 19 can be moved horizontally by means of the upper horizontally running trolleys 16 and also vertically by the operation of the winders 20.

A mechanism for moving the protecting net required for preventing scattering and falling of dust etc. during work by the moving scaffold in accordance with the horizontal movement of the moving scaffold 19 will now be described.

As shown in FIGS. 1 and, 2A and 2B, the protecting net 21 is hung from the two outside trolleys 16a through a hanging frame 22. This hanging frame 22 is made in the form of a frame consisting of two side beams 22a which are disposed in planes normal to the wall surface and a hanging beam 22b which is parallel to the upper provisional horizontal rails 14 (In FIG. 1, illustration of the side beams 22a is omitted for clearly showing the two outside driven trolleys 16a). The size of this hanging frame 22 as viewed in its plan i.e., the length of the hanging beam 22b and the length of the side beam 22a as viewed in the plan, is such that the the length of the hanging beam 22b is larger than the width of the moving scaffold 19 and the length of the side beam 22a is larger than the length of the moving scaffold 19 in a plane normal to the wall surface so that the hanging frame 22 can enclose the moving scaffold 19 therein sa viewed from above.

For hanging the protecting net 21 from the outside driven trolleys 16a, the side beams 22a are hung from the hooks 16f.

A protecting net platform 23 which serves for protecting purpose is disposed at a position slightly below the lowermost position of the moving scaffold 19. Lower provisional horizontal rails 24 are provisionally mounted on the lower wall surface so that the protecting net platform 23 can move horizontally maintaining only a small gap with respect to the wall surface.

As the lower provisional horizontal rails 24, rails of a squarish C-shaped cross section made of channel steel having a lip portion are secured to the wall surface by means of anchors 25. After hanging the moving scaffold 19 and arranging the moving scaffold 19 to a usable condition, the lower provisional horizontal rails 24 are mounted on the wall surface from inside the moving scaffold 19. The lower provisional horizontal rails 24 are mounted in parallel with and in about the same length as the upper provisional horizontal rails 14.

The upper end portions of wires 26 for hanging the protecting net platform 23 are tied to the two outside driven trolleys 16a whereas the lower end portions of the wires 26 are connected to winders 27 of the protecting net platform 23. On both sides of the protecting net platform 23 are mounted lower horizontally running trolleys 28 which, as shown in an enlarged scale in FIGS. 2A and 2B, comprise rollers 28a which are adapted to run along the rails 24. One of the rollers 28a is connected to a motor 28b through a reduction gear (not shown) and driven by this motor 28b.

Accordingly, this protecting net platform 23 can move horizontally along the lower provisional horizontal rails 24 and, in such horizontal movement, the speed of the lower horizontally running trolleys is so controlled that it is synchronized with the speed of the horizontal movement of the upper horizontally running trolleys 16.

Between the protecting net platform 23 and the hanging frame 22 hung from the upper horizontally running trolleys 16 are provided wires 29 which are suspended from the end portions of the hanging beam 22b and connected to the protecting net platform 23. The protecting net 21 is stretched in parallel to the wall surface between the front side wires 29, the hanging beam 22b and the protecting net platform 23. The protecting net 21 is stretched also between the side beams 22a and the protecting net platform 23. Thus, the moving scaffold 19 is enclosed by the protecting net 21 and the protecting net platform 23.

Mounting of the work apparatus 10 having the above described construction is made in the following manner:

First, the support frames 12 of a neceesary number for supporting the rail supports 13 are secured fixedly by tightening the screw jacks 12f on the parapet 2 of the building 1 at a predetermined interval therebetween. Thereafter, the posts 13a of the rail supports 13 are fitted in the cylindrical support portions 12d of the support frames 12 and the horizontal arms 13d of the rail supports 13 are positioned above the parapet 2 or the roof of the building 1.

Then, the connecting portions of the upper provisional horizontal rails 14 are placed on the rail supports 13 and the rails 14 are mounted rotatably on the rail supports 13 by inserting the connecting pins 15 through the brackets 14a and 14b and the openings of the horizontal arms 13d.

After disposing the upper provisional horizontal rails 14 in the connected state over the range necessary for the work on the wall surface, the three driven trolleys 16a and the single drive trolley 16b of the upper horizontally running trolleys 16 are mounted on the upper provisional horizontal rails 14 and these trolleys 16 are connected to one another by the connecting rod 16c. The upper end portions of the wires 18 for hanging the moving scaffold 19 and the wires 26 for hanging the protecting net platform 23 are connected to the hooks 16f of the trolleys 16. Then, the rail supports 13 are rotated to displace the upper provisional horizontal rails 14 to a position outside of the parapet 2 by a predetermined distance. The flanges 12e of the support frames 12 and the flanges 13b of the rail supports 13 are fixed rigidly by fastening by bolts or inserting pins to prevent rotation of the rail supports 13.

Thereafter, the wires 18 are connected to the winders 20 of the moving scaffold 19 located on the ground. By controlling the winders 20 inside the moving scaffold 19, the moving scaffold 19 can be moved vertically and, by controlling the motor 16g for driving the upper horizontally running trolleys 16, the moving scaffold 19 can be moved horizontally. Thus, the moving scaffold 19 can be displaced to any desired position on the wall surface.

After the moving scaffold 19 has been put to an operable condition in this manner, the lower provisional horizontal rails 24 are fixed on the wall surface directly by means of the anchors 25 by a work made in the moving scaffold 19.

Then, the protecting net platform 23 is connected to the wires 26 hung from the two outside driven trolleys 16a and the protecting net platform 23 is elevated to a predetermined position by operating the winders 27 at which the lower horizontally running trolleys 28 are connected to the protecting net platform 23 so as to enable the platform 23 to slide along the lower provisional horizontal rails 24.

Then the hanging frame 22 for the protecting net 21 is hung from the roof of the building 1 and connected to the driven trolleys 16a and the protecting net 21 is stretched between the hanging frame 22 and the protecting net platform 23.

By completion of stretching of the protecting net 21, the preparation for the work on the wall surface has been completed and it is now possible to start the work on the moving scaffold 19.

Since the range of vertical movement of the moving scaffold 19 is covered with the protecting net 21, the work on the moving scaffold 10 can be performed in the conventional manner. In case the moving scaffold 19 is moved horizontally, the protecting net platform 23 is moved horizontally with the moving scaffold 19 by the upper horizontally running trolleys 16 whereby the area of the wall surface on which the work from the moving scaffold 19 is to be performed is covered by the protecting net 21.

Figure 8:
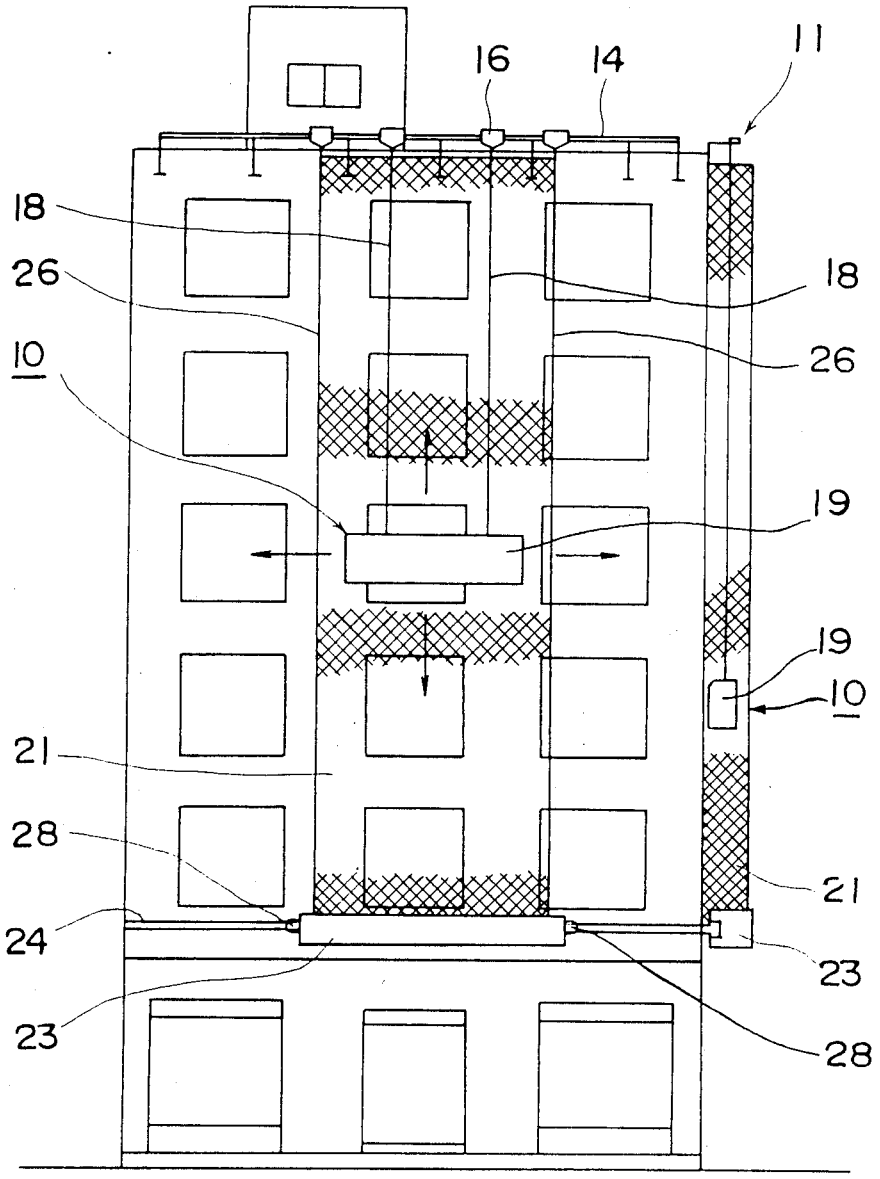

Accordingly, as shown in FIG. 8, the work on the wall surface can be performed while the area of the wall surface on which the work is to be performed can be constantly covered by the protecting net 21 by covering the wall surface portion corresponding to the width of the moving scaffold 19 by the protecting net 21 and moving this protecting net 21 horizontally in synchronism with the horizontal movement of the moving scaffold 19.

Since the protecting net platform 23 is moved along the lower provisional horizontal rails 24, the protecting net platform 23 is maintained at a position which is sufficiently close to the wall surface for preventing falling and scattering of dust etc. while avoiding contact with the wall surface. Further, according to the provisional horizontal device 11 of this work apparatus 10, the rail supports 13 can be rotated to a position above the parapet or the roof of the building 1 in mounting the upper provisional horizontal rails 14 so that the operator need not lean out of the parapet 2 and therefore he can perform the mounting of the rails safely and accurately.

Figure 10:
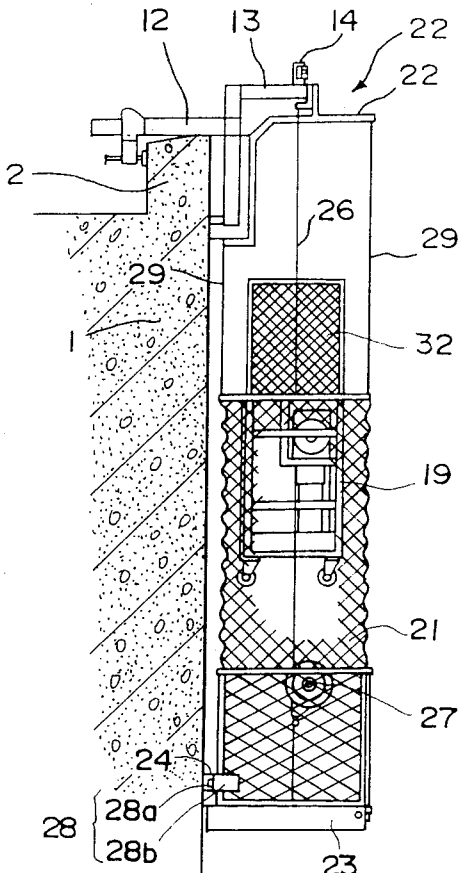
Figure 9:
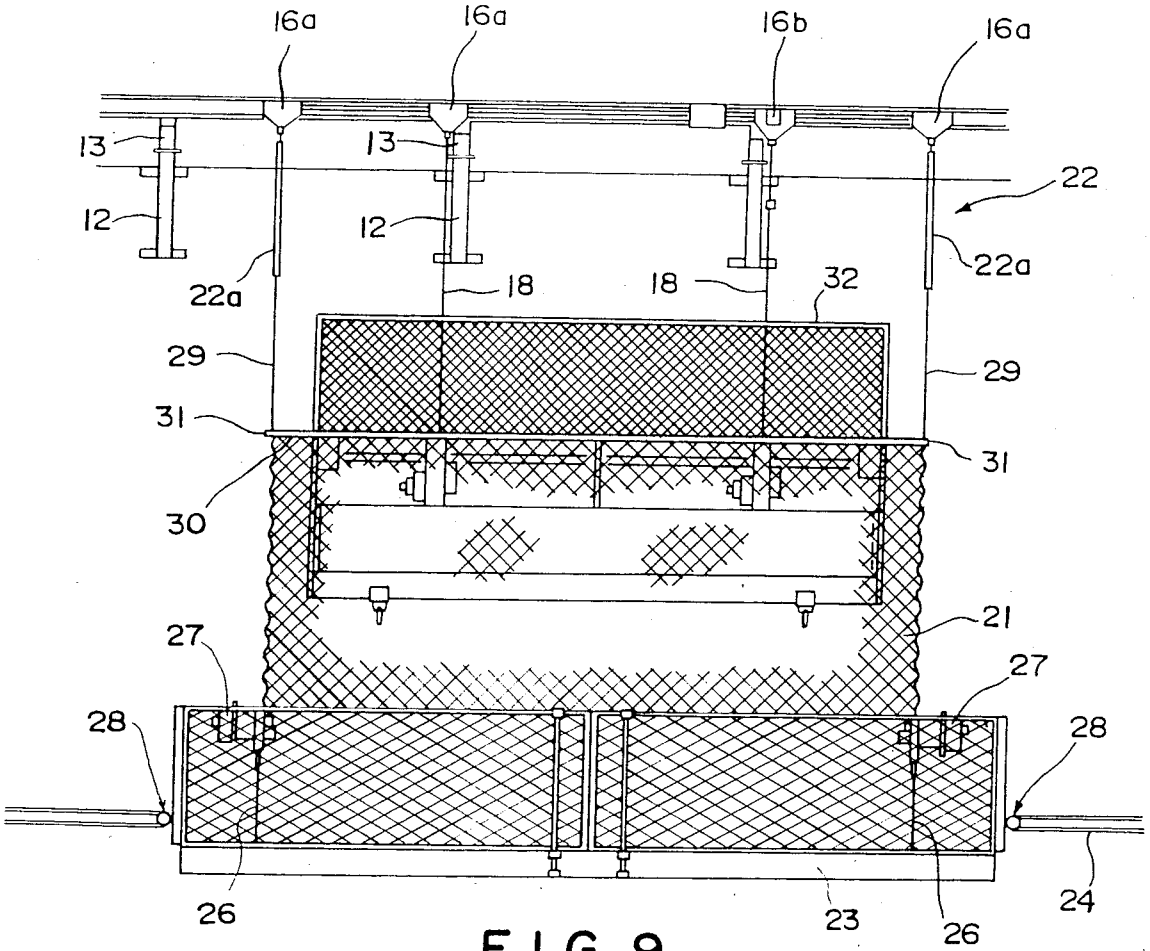

Another embodiment of the invention will be described with reference to FIGS. 9 through 11. In this embodiment, the same reference numerals designate the same components as those in the embodiment of FIGS. 1 through 8 and description of these components parts in detail will be omitted.

In this embodiment, the protecting net 21 necessary for work on the moving scaffold is stretched over the moving scaffold 19 and over a portion of the wall surface lower than the moving scaffold 19. This embodiment is based on the concept that it is unnecessary to cover a portion of the wall surface above the working range of the moving scaffold 19.

In this embodiment, a hanging frame 22 hung from two outside driven trolleys 16a of upper horizontally running trolleys 16 consists only of side beams 22a which are disposed in planes normal to the wall surface. Guide wire 29 are provided between the front and rear portions of each side beam 22a and the protecting net platform 23.

To the moving scaffold 19 is secured a protecting net frame 30 which is open on the side opposing the wall surface and is provided with four guide pipes 31 at corners of the moving scaffold 19 for inserting the wires 29 therethrough.

A protecting net 21 is provided between this protecting net frame 30 and the guide wires 29 in such a manner that the protecting net 21 is secured at the upper end portion thereof to the protecting net frame 30 and hung therefrom, a superfluous portion of the protecting net 21 being stored in the protecting net platform 23. The side portions of the protecting net 21 are secured to the guide wires 29 by means of metal rings or the like.

As the moving scaffold 19 for performing a work on the wall surface is moved vertically, the protecting net frame 30 which is fixed to the moving scaffold 19 is likewise moved vertically. For this reason, the length of the protecting net 21 is determined at such a value that the protecting net 21 can cover the wall surface portion lower than the moving scaffold 19 in a state where the moving scaffold 19 is at the most elevated position. The protecting net 21 therefore is stored in the protecting net platform 23 as the moving scaffold 19 is lowered.

For covering space above the working range of the moving scaffold 19, a protecting net frame 32 is secured to the moving scaffold 19 at a location above the working range of the moving scaffold 19. The frame 32 includes horizontal beams which oppose the wall surface above the working range of the moving scaffold 19 and side beams arranged in planes normal to the wall surface on both sides of the horizontal beams. The protecting net 21 is provided between these beams whereby a fixed type protecting net system is formed.

Figure 11:
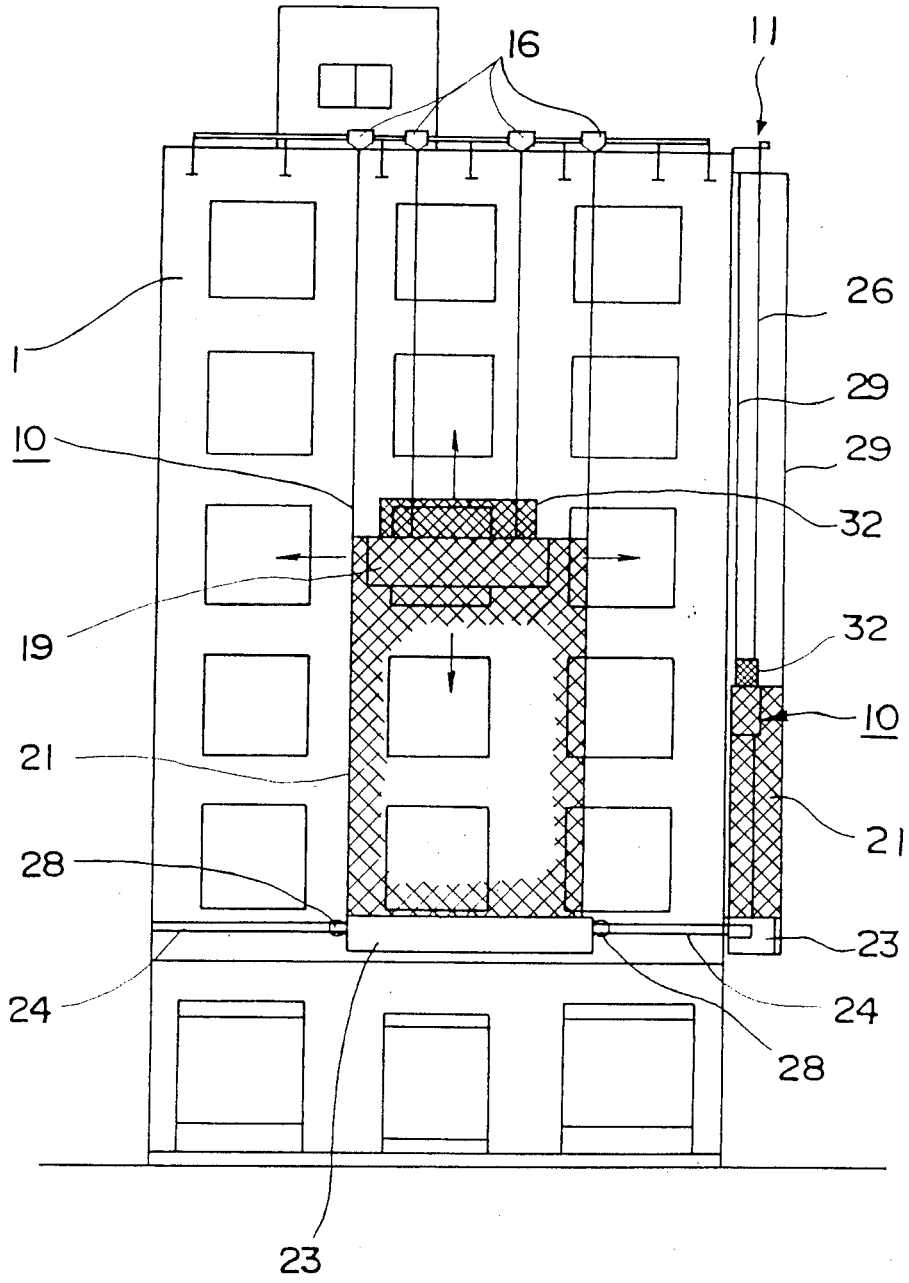

According to this embodiment, as shown in FIG. 11, a necessary portion of the wall surface only is covered by the protecting net 21 without covering a portion of the wall surface above the moving scaffold 19. Accordingly, influence to the building which is being used can be held to the minimum.

In the above described embodiments, description has been made about a case where the work apparatus is a moving scaffold. The invention however is not limited to the moving scaffold but it may be applied to other work apparatus widely including scaffolds such as one in which a device for moving the scaffold is mounted on a horizontally running trolley and other unmanned machines.

The structure to be worked on is not limited to a building but may be other structure including a ship, power station, tank, chimney and bridge.

The protecting material is not limited to the protecting net but other material such as canvas sheet may be employed depending upon the nature of the work to be performed on the wall surface of the structure.

What is claimed is:

1. A work apparatus for performing work on a wall surface comprising:

rail supports secured fixedly to an upper end portion of a structure and having a foremost end portion projecting out of the structure;

upper provisional horizontal rails supported provisionally on said rail supports;

lower provisional horizontal rails mounted provisionally on a lower portion of a wall surface of the structure in parallel with the upper provisional horizontal rails;

upper horizontally running trolleys mounted slidably on the upper provisional horizontal rails and connected to one another;

a working platform hung from the upper horizontally running trolleys and means for moving the working platform in the vertical direction;

a hanging frame hung from the upper horizontally running trolleys;

a protecting material hung from the hanging frame and adapted to enclose the working platform;

a protecting material platform connected to the lower end of the protecting material; and lower horizontal running trolleys secured to the protecting material platform and mounted slidably on the lower provisional horizontal rails.

2. A working apparatus as defined in claim 1 which further comprises means for providing vertical movement of the protecting material wherein said protecting material covers only a portion of the wall surface below the middle portion of the working platform.

3. A working apparatus as defined in claim 1 wherein said working platform is a moving scaffold.

4. A working apparatus as defined in claim 1 wherein said protecting material is a protecting net.

* * * * *